United States Patent [19]

Katzin

[11] 4,109,434

[45] Aug. 29, 1978

[54] MODULAR BASEBOARD MOLDING

[76] Inventor: Lawrence F. Katzin, 1414 Scales St., Raleigh, N.C. 27608

[21] Appl. No.: 767,793

[22] Filed: Feb. 11, 1977

[51] Int. Cl.[2] ..... E04C 2/38

[52] U.S. Cl. ..... 52/287; 52/716

[58] Field of Search ..... 52/288, 287, 290, 716; 85/11

[56] References Cited

U.S. PATENT DOCUMENTS

| | | | |
|---|---|---|---|
| 1,011,642 | 12/1911 | Patterson | 52/288 X |
| 2,303,864 | 12/1942 | Reasor | 52/287 X |
| 3,198,057 | 8/1965 | Moore | 85/11 X |
| 3,216,164 | 11/1965 | Stillman | 52/287 X |
| 3,408,250 | 10/1968 | Finefrock | 52/287 X |
| 4,010,297 | 3/1977 | Wenrick | 52/716 X |

FOREIGN PATENT DOCUMENTS

| | | | |
|---|---|---|---|
| 905,798 | 9/1962 | United Kingdom | 52/287 |

*Primary Examiner*—Ernest R. Purser
*Assistant Examiner*—Carl D. Friedman
*Attorney, Agent, or Firm*—Mills & Coats

[57] ABSTRACT

In abstract a preferred embodiment of this invention is a modular baseboard and shoe molding assembly which can be sold as a unit, can be handled as a unit, cut and trimmed as a unit and when installed has adequate flexibility to contour and conform to variations in the ambient structure.

7 Claims, 9 Drawing Figures

MODULAR BASEBOARD MOLDING

This invention relates to building materials and more particularly to modular baseboard and shoe molding trim.

BACKGROUND OF THE INVENTION

In residential homes, as well as other structures, there is a great deal of what is termed finish carpentry. Skilled labor is required to perform this type of work and it is very time consuming and therefore expensive. In view of this, every effort is made to cut corners and to reduce the cost of finish work.

One particular type of finish work that requires a substantial amount of labor and expense concerns the application of molding. In particular, the molding which is used at the base of interior walls is costly to install but yet remains a high demand item. The reason for this is that baseboard molding serves both an esthetic and a functional purpose. First of all, this type of molding covers unsightly gaps which may exist between walls and floors. Second, it seals the area between walls and floors thereby having an insulating effect.

Up until the present, baseboard molding has been applied in a two step process. The first step was performed by cutting and mitering a section of baseboard plank to the desired length and nailing the same to a walls lower edge adjacent the floor. The next step was cutting and mitering a section of shoe molding to the desired length. The shoe molding was then attached to the area adjacent the baseboard plank and the floor. Since shoe molding is flexible, it conforms to dips and unlevel surfaces which invariably exist in floor. Shoe molding, therefore, generally seals the area between walls and floors by supplementing the covering and sealing capability of the baseboard plank.

Since both baseboard plank and shoe molding are needed to effectively trim an area, it can be appreciated the large amount of time and labor required to install them.

SUMMARY OF THE INVENTION

After much study and reflection into the above mentioned problems, the present invention has been developed to present a modular baseboard molding which incorporates both the baseboard plank and shoe molding into a cooperatively associated unit. The particular construction of the present invention allows for the simultaneous cutting and mitering of both the baseboard plank and shoe molding. Furthermore, the modular baseboard molding may be installed as a unit such that both the baseboard plank and shoe molding can be securely and properly disposed along the area adjacent a wall and floor.

In addition to the above, the present invention may be broken down into its individual components, i.e., baseboard plank and shoe molding after the cutting and mitering operation is performed thereby allowing the baseboard plank and shoe molding to be installed separately if so desired.

It is therefore an object of the present invention to provide a modular baseboard molding whereby said molding can be installed as a unit thus reducing installation time.

Another object of the present invention is to provide a modular baseboard molding comprised of a baseboard plank and shoe molding.

Another object of the present invention is to provide a modular baseboard molding whose components are cooperatively connected whereby said components may be simultaneously cut and mitered.

A further object of the present invention presents a modular baseboard molding whose components may be securely and properly attached to the area adjacent a particular wall and floor without said components being completely previously separated from each other.

An even further object of the present invention is to present a modular baseboard molding whose components are cooperatively connected by a flexible means whereby each component may be secured and properly placed and disposed along the area adjacent a wall and floor.

Another object of the present invention is to present a modular baseboard molding whose components may be individually installed along the area adjacent to a wall and floor after said components have been simultaneously cut and mitered.

Other objects and advantages of the present invention will become apparent from a study of the following description and the accompanying drawings which are merely illustrative of the present invention.

DESCRIPTION OF THE PREFERRED EMBODIMENT

Figure 1:
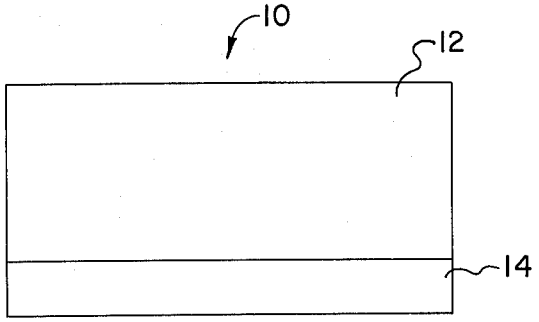
FIG. 1 is a front elevational view of a section of modular baseboard molding.
Figure 2A:
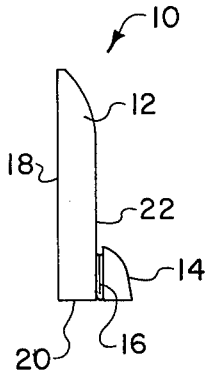
FIG. 2A is a side elevational view of FIG. 1.
Figure 2B:
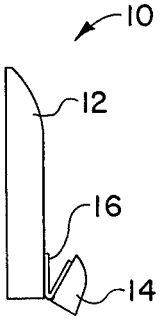
FIG. 2B is a side elevational view of a section of modular baseboard molding illustrating the shoe molding being attached to the baseboard plank by a flexible connecting means.
Figure 3:
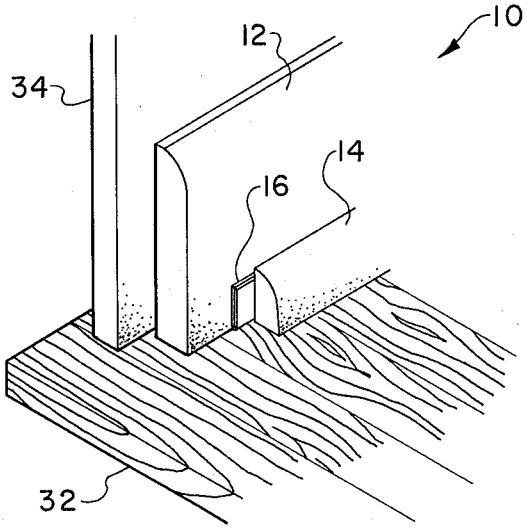
FIG. 3 is a fragmentary perspective view of the modular baseboard molding of the present invention showing the same installed along the area adjacent to a wall and floor.

With further reference to the drawings, particularly FIGS. 1, 2A and 2B, a length of modular baseboard molding is shown therein and indicated generally by the numeral 10. Modular baseboard molding 10 is preferably constructed of wood and comprises a baseboard plank 12, shoe molding 14, and flexible adhesive type tape 16.

More specifically, extending along the lower outer surface 22 of baseboard plank 12 is shoe molding 14. As illustrated in FIGS. 2A and 2B, a strip of adhesive tape 16 provides a means for flexibly attaching the shoe molding 14 to baseboard plank 12. The adhesive tape 16 may provide a continuous flexible bond between the baseboard and shoe molding or may be applied in relatively short strips such that the operative relationship between the baseboard plank and shoe molding remains functionally the same.

It should be pointed out that the flexible adhesive tape 16 is of such a strength and gauge that it not only holds the baseboard plank and shoe molding together but also allows a flush fit between outer surface 22 and shoe molding 14 when shoe molding 14 is positioned directly adjacent the outer surface 22 of baseboard plank 12 as illustrated in FIG. 2A. Furthermore, flexible adhesive tape 16 is applied to the modular baseboard molding such that the tape is concealed by shoe molding 14 even after the modular baseboard molding is installed.

Tape 16 could, of course, be disposed along at least a portion of the bottom of said baseboard plank and shoe molding thus securing the same as described above.

Figure 6:
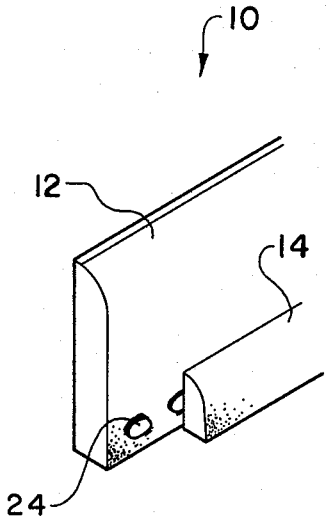
FIG. 6 is a perspective view of the modular baseboard molding illustrating an alternate method of flexibly attaching the shoe molding to the baseboard plank.
Figure 7:
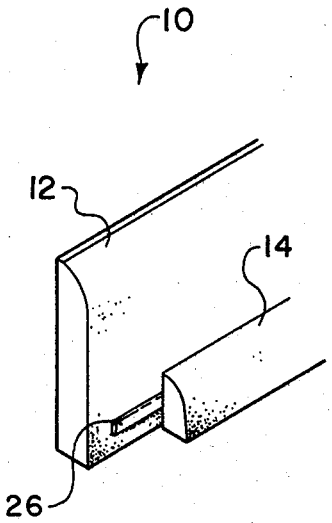
FIG. 7 is a perspective view of the modular baseboard molding illustrating another alternate method of flexibly attaching the shoe molding to the baseboard plank; and, FIG. 8 is a perspective sectional view of the modular baseboard molding installed along the area adjacent a wall and floor, said molding incorporating an alternate method of flexibly attaching the shoe molding to the baseboard plank.
Figure 8:
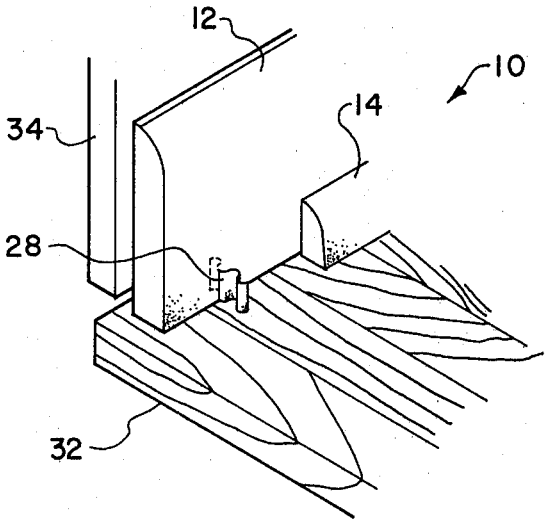

FIGS. 6, 7 and 8 illustrate alternate methods for attaching shoe molding 14 to baseboard plank 12. The alternate methods shown function in the same way as the adhesive tape method.

More specifically, FIG. 6 shows shoe molding 14 being attached to the baseboard plank 12 by longitudinally spaced areas of an adhesive 24. Said adhesive 24 being of a type which will provide a flexible bond between baseboard plank 12 and shoe molding 14.

The adhesive 26 shown in FIG. 7 is applied in a continuous strip between baseboard plank 12 and shoe molding 14 to provide a continuous attaching means for bonding the same. The adhesive used in the method represented in FIG. 7 is of the same type as that which is shown in FIG. 6.

Illustrated in FIG. 8 is another alternate method of cooperatively attaching the baseboard plank 12 to shoe molding 14. The modular baseboard molding of FIG. 8 incorporates a corrogated fastener 28 to join the baseboard plank and shoe molding such that both may be cut and mitered simultaneously. Furthermore, corrogated fastener 28 provides an attachment which permits shoe molding 14 to be properly seated against the floor during installment of the modular baseboard molding.

If desired, the modular baseboard molding of the present invention could be made as a single unit with a separable umbilical area formed between the baseboard plank and the shoe molding portions.

It should be understood that all of the above-described methods of attaching the baseboard plank to the shoe molding are adapted to allow only up and down coplanar movement between the same. Therefore, the shoe molding, which is relatively flexible, may be allowed to easily conform to the curvature of an unlevel floor during installation.

The modular baseboard molding of the present invention can in one operation be cut and mitered to the desired length for installation. Also, the actual installation of the same is a one step operation which is performed in a certain sequence.

Figure 4:
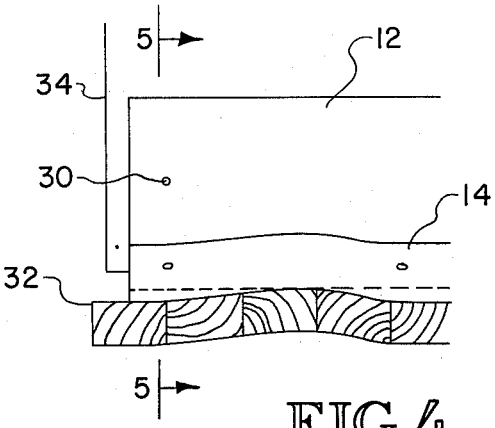
FIG. 4 is a front elevational view of the present invention showing a cross sectional view of unlevel flooring with the modular baseboard molding installed thereabove.
Figure 5:
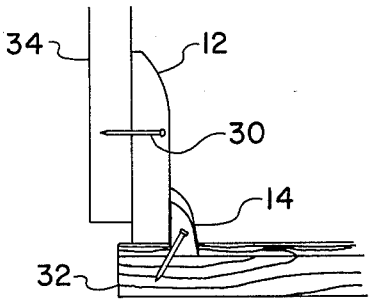
FIG. 5 is a side elevational sectional view of the modular baseboard molding of the present invention taken along the line 5—5 in FIG. 4.

First, the mitered modular baseboard molding is juxtaposed along an area of a wall adjacent the floor. The carpenter then nails the baseboard plank to the wall. As seen in FIGS. 4 and 5, baseboard plank 12 is resting against high spots in floor 32 and nail 30 is driven through baseboard plank 12 and into wall 34. Next, shoe molding 14, which is flexibly attached to plank 12, is nailed along the area adjacent baseboard plank 12 and floor 32. As can be seen in FIGS. 4 and 5, shoe molding 14 is toenailed to the floor thereby causing shoe molding 14 to flex and conform to the irregular contour of floor 32.

It is quite obvious to anyone skilled in the art that the present invention can substantially reduce the time required to install baseboard plank and shoe molding. It may also be appreciated that the components of the present invention can be cut and mitered simultaneously and then be installed either as a unit or separately. Also, the extra cost of producing the present invention is insignificant as composed to the savings realized from installation.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A modular baseboard molding comprising; an elongated basebord plank having at least a front, a back, a bottom, and two encs; an elongated shoe molding strip having at least a front, a back, a bottom and two ends, the back of said strip lying juxtaposed to the front of said plank with the bottoms of said strip and plank lying substantially in the same plane; and an elongated strip of adhevise type tape for movably fastening said strip to said plank for planar movement between said juxtaposed surfaces whereby one or both ends of said juxtaposed plank and strip can be cut at the same time for proper fitting of the back of the baseboard plank adjacent a wall or other structure and the bottom of the shoe mold strip can be moved to conform to the contour of the adjacent floor surfaces.

2. The modular baseboard molding of claim 1 wherein the fastening means between said plank and said strip is releasable.

3. The modular baseboard molding of claim 1 wherein said plank and said strip are movably fastened whereby planar movement between the juxtaposed surfaces can be accomplished.

4. The modular baseboard molding of claim 1 wherein the fastening means is a stretchable adhesive material.

5. The modular baseboard molding of claim 1 wherein the fastening means is a plurality of corrugated fasteners.

6. A modular baseboard molding comprising; an elongated baseboard plank having at least a front, a back, a bottom, and two ends; an elongated shoe molding strip having at least a front, a back, a bottom, and two ends, the back of said strip lying juxtaposed to the front of said plank with the bottoms of said strip and plank lying substantially in the same plane; and a stretchable adhesive material for movably fastening said strip to said plank for planar movement between said juxtaposed surfaces whereby one or both ends of said juxtaposed plank and strip can be cut at the same time for proper fitting of the back of the baseboard plank adjacent a wall or other structure and the bottom of the shoe mold strip can be moved to conform to the contour of the adjacent floor surfaces.

7. A modular baseboard molding comprising; an elongated baseboard plank having at least a front, a back, a bottom, and two ends; an elongated shoe molding strip having at least a front, a back, a bottom, and two ends, the back of said strip lying juxtaposed to the front of said plank with the bottoms of said strip and plank lying substantially in the same plane; and a plurality of corrugated fasteners for movable fastening said strip to said plank for planar movement between said juxtaposed surfaces whereby one or both ends of said juxtaposed plank and strip can be cut at the same time for proper fitting of the back of the baseboard plank adjacent a wall or other structure and the bottom of the shoe mold strip can be moved to conform to the contour of the adjacent floor surfaces.

* * * * *